US005484234A

United States Patent [19]

Worden

[11] Patent Number: 5,484,234

[45] Date of Patent: Jan. 16, 1996

[54] BUILDING MODULE FOR PLANTABLE WALLS WITH A BULK FILLING MATERIAL

[76] Inventor: Leonard A. Worden, 11 Meadowcrest Rd., Hooksett, N.H. 03106

[21] Appl. No.: 315,838

[22] Filed: Sep. 30, 1994

[51] Int. Cl.[6] ..... E02D 29/02

[52] U.S. Cl. ..... 405/284; 405/286; 47/83; 52/592.6

[58] Field of Search ..... 405/262, 284–287; 52/169.2, 169.3, 604, 592.6, 503; 47/82, 83

[56] References Cited

U.S. PATENT DOCUMENTS

| | | | |
|---|---|---|---|
| 875,235 | 12/1907 | Bastel | 47/82 |
| 1,217,239 | 2/1917 | Swartz | 47/82 X |
| 1,472,917 | 11/1923 | Laird . | |
| 1,733,790 | 10/1929 | Gilman . | |
| 1,943,800 | 1/1934 | Morrison | 61/30 |
| 1,953,005 | 3/1934 | Nagel | 61/47 |
| 2,092,385 | 9/1937 | Arble | 61/47 |
| 2,149,957 | 3/1939 | Dawson | 61/47 |
| 2,301,592 | 11/1942 | Teuber | 61/47 |
| 2,828,613 | 4/1958 | Wilson | 61/47 |
| 2,972,870 | 8/1957 | Cooper | 61/47 |
| 3,198,614 | 8/1965 | Powell | 61/47 |
| 3,365,840 | 1/1968 | Cooper | 47/82 |
| 3,877,236 | 4/1975 | O'Neill | 61/47 |
| 4,081,969 | 4/1978 | Clarke | 405/286 |
| 4,293,245 | 10/1981 | Jaecklin | 405/272 |
| 4,384,810 | 5/1983 | Neumann | 405/284 |
| 4,433,944 | 2/1984 | Plica et al. | 405/284 |
| 4,524,551 | 6/1985 | Scheiwiller | 52/98 |
| 4,815,897 | 3/1989 | Risi et al. | 405/284 |
| 4,818,150 | 4/1989 | Jaecklin | 405/262 |
| 4,930,939 | 6/1990 | Jaecklin | 405/262 |
| 5,017,050 | 5/1991 | Jaecklin | 405/284 |
| 5,066,169 | 11/1991 | Gavin | 405/284 |
| 5,108,232 | 4/1992 | Strassil | 405/286 |
| 5,139,369 | 8/1992 | Jaecklin | 405/262 |
| 5,181,351 | 1/1993 | Jaecklin | 52/35 |

FOREIGN PATENT DOCUMENTS

| | | | |
|---|---|---|---|
| 2506366 | 11/1982 | France | 405/284 |
| 2513268 | 6/1978 | Germany . | |
| 2822294 | 12/1979 | Germany | 47/83 |
| 3023102 | 1/1982 | Germany | 47/83 |
| 3836437 | 5/1990 | Germany | 47/82 |
| 4030270 | 3/1992 | Germany | 47/82 |

*Primary Examiner*—Ramon S. Britts
*Assistant Examiner*—Frederick L. Lagman
*Attorney, Agent, or Firm*—Hopkins & Thomas; James W. Kayden

[57] ABSTRACT

A building module for the erection of plantable bin walls which can be used as freestanding, sound absorbing/reducing walls and retaining walls. Each module has two longitudinal bins separated and supported by a cross beam and two cross beams support blocks. The longitudinal bins run parallel to the wall plane and have weirs at both ends which retain water within the bin to support plant growth therein.

29 Claims, 4 Drawing Sheets

BUILDING MODULE FOR PLANTABLE WALLS WITH A BULK FILLING MATERIAL

BACKGROUND OF THE INVENTION

1. Field of the Invention

This invention relates to building modules for the erection of walls, more particularly for freestanding, sound absorbing/reducing walls and retaining walls. These are particularly modular elements comprising at least two subelements, preferably in the form of beams arranged at an angle to one another. The modules may be regarded also as a building module kit from which at least one or more complete modules can be assembled. Accordingly, the term "building module" is intended to comprise unitary modules as well as multi-pan and more complex modules.

In many cases, one of the subelements or beams is constructed as a longitudinal beam extending substantially parallel to the wall plane and comprising at least two cross-beams arranged at an angle to one another. The cross beams extend between a pair of the longitudinal beams, in a direction transverse to the wall plane. Two of said cross-beams form support blocks with planar top and bottom sides which act as spacing means between the individual modules. Each module is designed to be held in place by gravity, its own weight, and the weight of a bulk filling material. Each module normally stacks upon another module to build up wall height, and is installed adjacent to another in an end-to-end arrangement to build wall length.

2. Background Art

The typical retaining wall or freestanding wall is usually constructed with a plurality of flame-like elements comprising at least two subelements, preferably in the form of beams arranged at an angle to one another and connected in a form locking or material locking manner. U.S. Pat. No. 4,384,810, to Neumann, describes a locking beam that forms a three dimensional lattice in a construction system for plantable shoring walls. Said lattice comprises support blocks with planar top and bottom sides which are stacked one above the other. The blocks act as spacing means between individual planting levels. The structure includes a longitudinal component consisting of a base plate and a breast part. The longitudinal component and the locking beam extend parallel to the wall plane and always rest on two support blocks. The support blocks are spaced apart a distance and extend in a direction transverse to the wall plane. Each of the consecutive stacks of the support block pairs, together with the longitudinal component, the locking beam, and the earth within, form a construction section acting as a static slope shoring unit.

U.S. Pat. No. 5,017,050, to Jaecklin describes building elements for supporting a grid wall with a bulk filling material comprising at least two subelements, preferably in the form of beams arranged at an angle to one another, and connected in a form locking or material locking manner.

There is at least one hole or recess in the cross beam which is open over a part of its circumferential contour and adapted to receive a longitudinal beam in order to establish a form locking connection between the beams. The beams are secured against separation and displacement from one another in a mounted state. The contour of the hole or recess overlaps the other side of the longitudinal beam so as to form an abutment. The recess is shaped so as to permit a partial lateral insertion of the longitudinal beam while establishing contact between the abutment and the longitudinal beam in a first rotational position. The longitudinal beam is then rotated downward through an arc until it is fully inserted into the recess. Once fully inserted, a form locking connection is established which cannot be reversed when the construction is under load.

U.S. Pat. No. 5,181,351 to Jaecklin, describes building elements for supporting grid walls with a bulk material filling. The frame-like elements of the invention comprise at least two subelements, preferably in the form of beams arranged at an angle to one another, and connected in a form locking or material locking manner.

One of the subelements or beams is constructed as a longitudinal beam extending substantially parallel to the wall plane and comprises at least two profile legs arranged at an angle to one another. The first of these profile legs forms at least one bearing surface for the bulk filling material, while the second of these profile legs forms a retaining surface for the bulk filling material facing the inside space of the frame.

Such structural elements or structural systems have heretofore not been concerned with the need for structural features which allow for the adequate supply and retention of water necessary to sustain maximum plant growth without costly replanting. It is to this need and to other deficiencies of the prior art that this invention is directed.

SUMMARY OF THE INVENTION

It is therefore, one object of the present invention to provide a plantable bin wall which can be used as a retaining wall, or freestanding, sound absorbing/reducing wall, using the same building module with no structural change.

It is another object of the invention to provide a module which can be offset in a direction transverse to the wall plane when one module is stacked on top of another module vertically. This is accomplished by use of an alignment key and alignment pockets on the planar top and bottom sides of the cross beam support blocks.

Another object of the present invention is to provide a module created by a monolithic single pour so as to form one structural member as opposed to having longitudinal elements and cross beam elements prefabricated as separate interlocking members and to provide a module with longitudinal bins having a wier at each end which results in the retention of rainfall, or water from any other source. The height of the weir determines the level of retained water.

A further object is to provide a module with root development slots lengthwise along the interior sides of the longitudinal bins and running parallel to the wall plane to allow plant roots to reach the soil at the wall base in order to establish permanent plant growth and to provide a module with a longer length than prior art wall modules to allow for larger coverage while requiring fewer footings.

A still further object of the present invention is to provide a module which will allow for an extra tall stacking design, thereby providing additional light for plant growth which will reduce costly replanting and to provide a module with holes passing through the cross beam support blocks which will allow for irrigation of the longitudinal bins.

An additional object of the present invention is to provide a module with equalizing holes passing through the cross beam support blocks which allow for even distribution of retained water throughout the length of the longitudinal bins for the purpose of enhancing plant growth and stability and to provide a bin wall with an extremely low center of gravity. This low center of gravity gives the wall far more stability than the current wall systems, thereby giving this wall a greater range of application.

Other objects and advantages will be readily apparent from the ensuing description.

BRIEF DESCRIPTION OF THE DRAWINGS

In order that the invention be more fully comprehended, it will now be described, by way of example, with reference to the accompanying drawings, in which.

DETAILED DESCRIPTION OF THE PREFERRED EMBODIMENT

Figure 1:
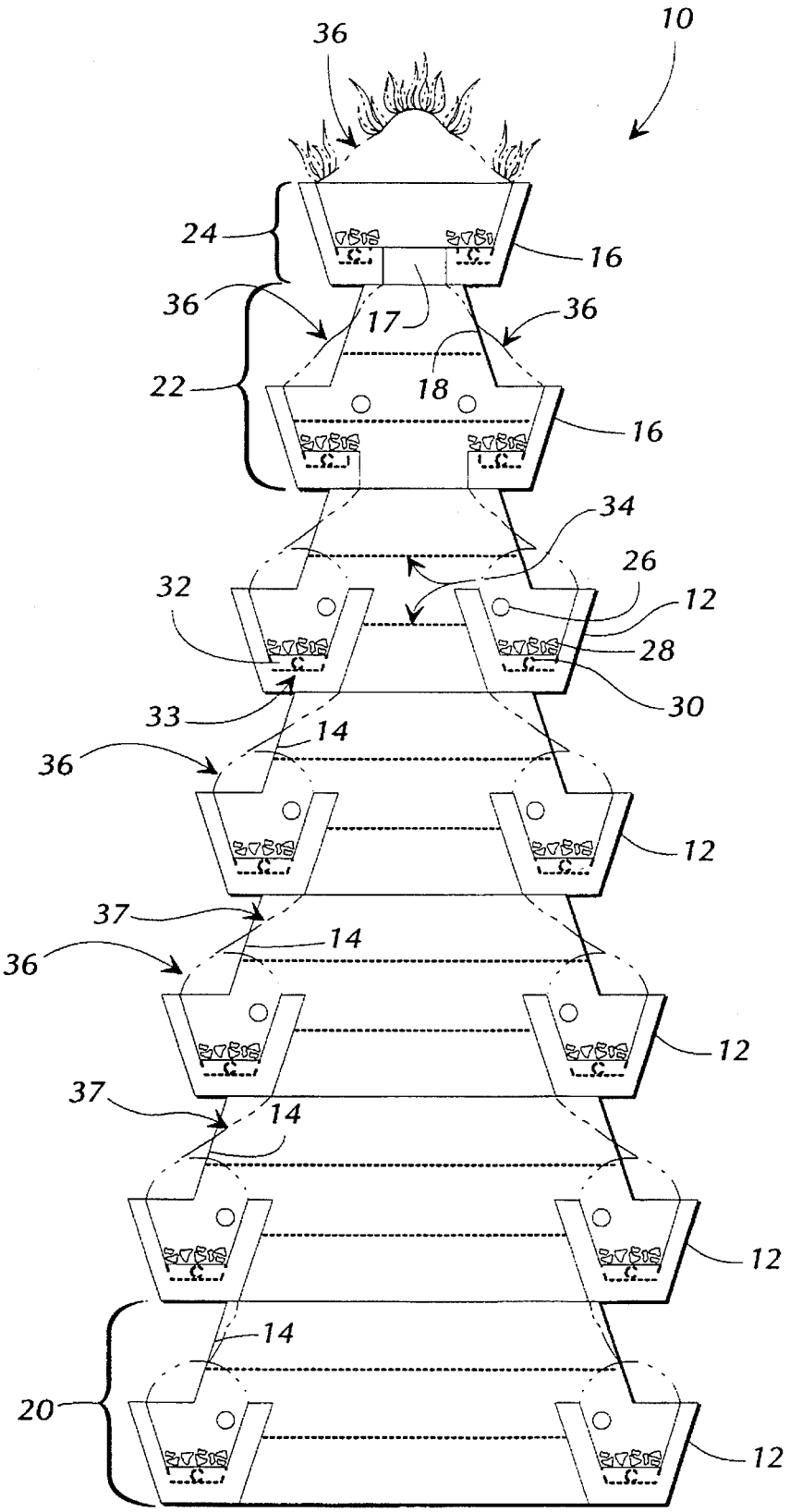
FIG. 1 is a side elevational view of a freestanding, sound absorbing/reducing wall constructed in accordance with the present invention showing several building modules stacked on top of another in a vertical direction.

The freestanding bin wall 10 according to FIG. 1 serves as a sound absorbing/reducing wall and consists of frame-like building modules placed on top of the other. Each building module 20, 22 and 24 is formed by a monolithic single pour and consists of front and rear longitudinal bins 12 and 16, at least two cross beam support blocks, 14, 17 or 18, and at least one cross beam 46 as illustrated in FIG. 4.

Figure 4A:
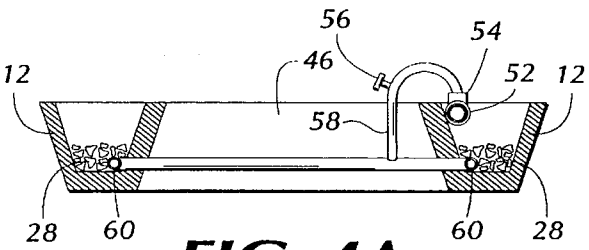
FIG. 4A is a cross sectional view of a typical building module at the center cross beam showing a preferred embodiment of the irrigation system, the section being taken on line 4A—4A of FIG. 4.
Figure 4:
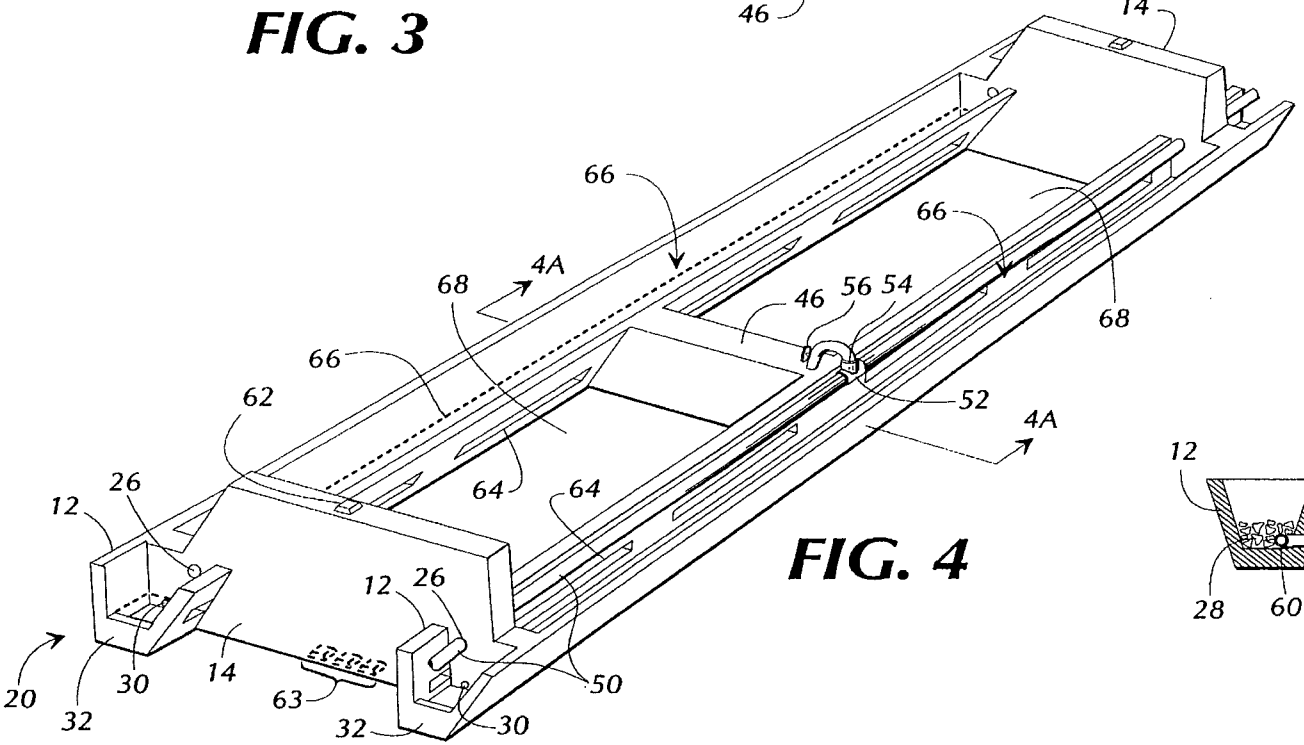
FIG. 4 is a perspective view of a typical building module showing two longitudinal bins, two cross beam support blocks, a center cross beam, and an irrigation system.
Figures 5, 6:
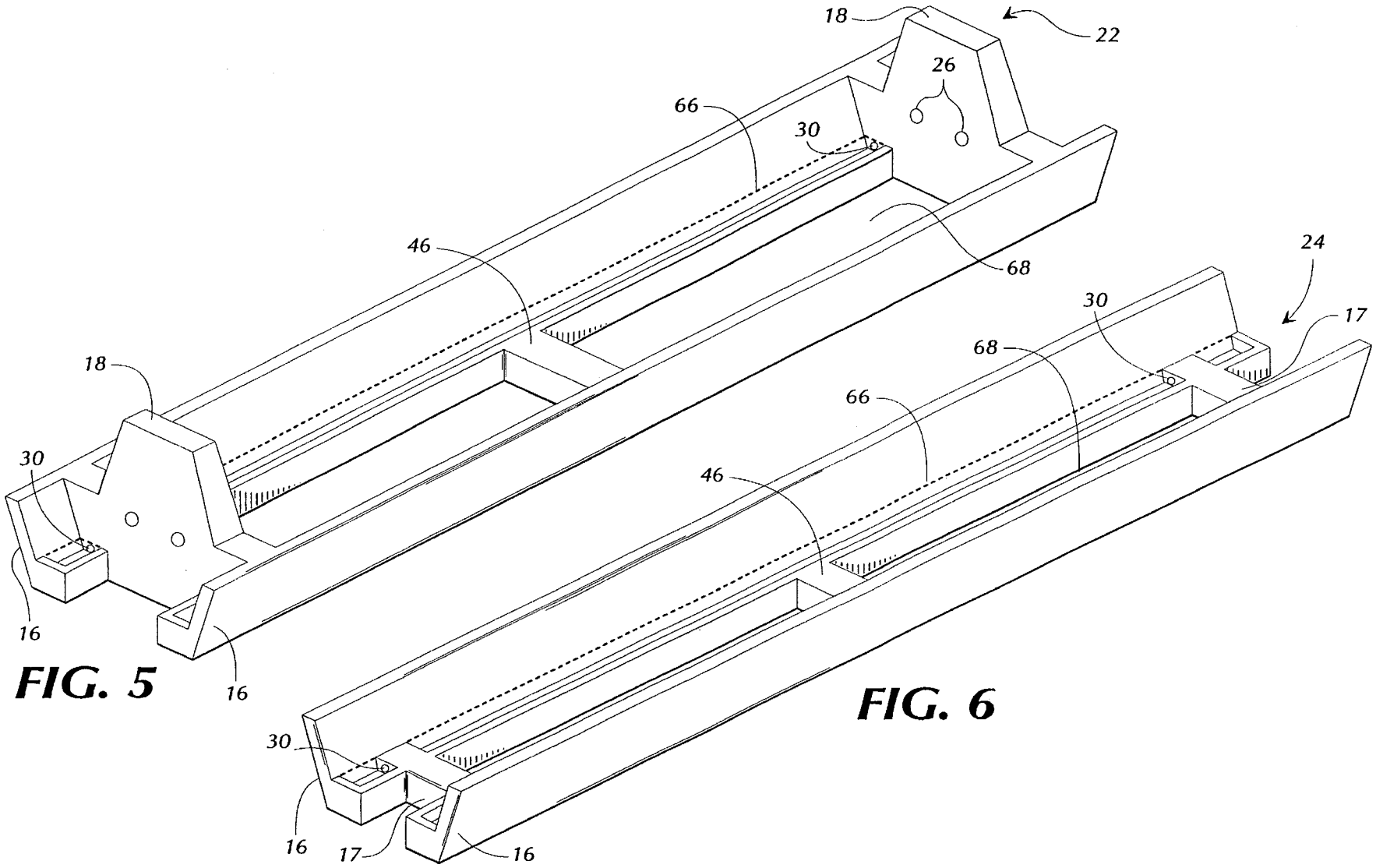
FIG. 5 is a perspective view of a building module which occupies the second tier from the top of the wall in the vertical direction.
FIG. 6 is a perspective view of a building module which occupies the top tier position of the wall in the vertical direction.

The longitudinal bins and cross beams are arranged at an angle to one another, preferably at right angles, and because of the monolithic single pour, form one contiguous building module as shown in detail in FIGS. 4, 5 and 6.

Figure 2:
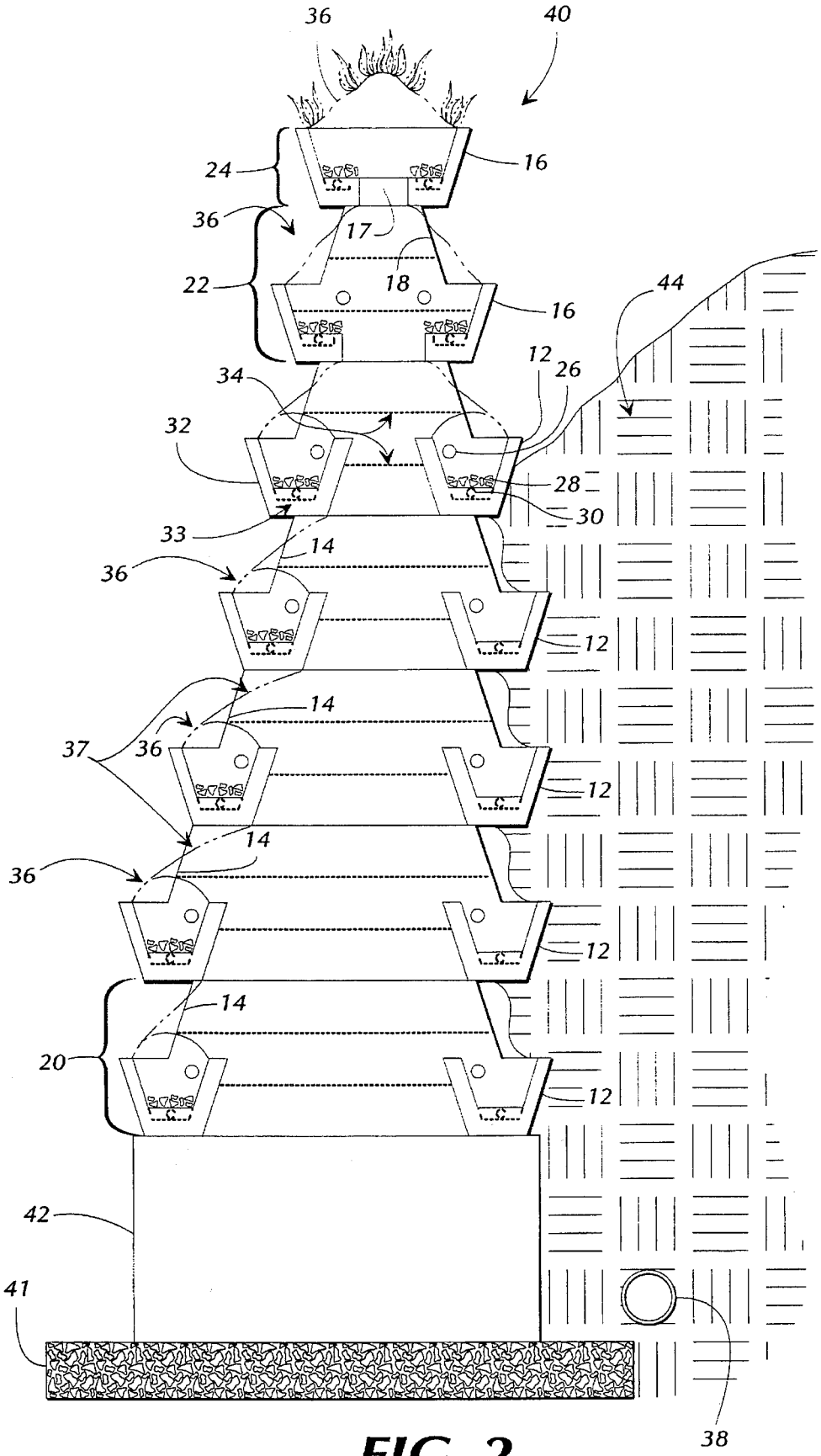
FIG. 2 is a side elevational view of a retaining wall with several building modules stacked one on top of another in a vertical direction and including a foundation element.

FIG. 2 shows another embodiment of the bin wall serving as a slope retaining wall 40. The lowermost building modules 20 in each case are anchored to a foundation 42 at each end of the building module 20. Each foundation 42 rests upon the structural fill 41. In an alternate embodiment, the foundations 42 could be replaced with structural fill and a three dimensional filter material that would run the length of the wall. This would be less restrictive on wall application, as well as more cost effective since deep digging through rock would no longer be required. The weight and force of the slope 44 is retained along one side of the bin wall 40. Ground water that would otherwise collect at the base of the slope 44 is carried away from the wall's foundation 42 by an underdrain 38 thereby inhibiting erosion.

As shown in FIG. 1 and FIG. 2 an important feature of each individual longitudinal bin 12 and 16, is the weir 32. The weir 32 is formed at each end of the longitudinal bins 12 and 16, and extends vertically a distance above the interior bottom surface 33 of the bin. Compared to known building modules, this design retains water within the longitudinal bins for the continued support of plant life. Cross beam support blocks 14, 17 and 18 have equalizing holes 30 above the interior bottom surface 33 of the bins which ensure that the retained water remains at a constant water level throughout the length of the longitudinal bins.

As the freestanding wall 10 in FIG. 1 and the retaining wall 40 in FIG. 2 are built up tier by tier; each building module 20, 22, and 24 representing one tier, a layer of rock 28 is deposited within each longitudinal bin 12 and 16. A suitable planting mix is then heaped onto the rock a suitable distance above the longitudinal bin. Gravel is then deposited within the interior spaces 68 of the building module 20 as shown in FIG. 4 and is compacted in three distinct layers, said layers being depicted by dotted lines 34, as shown in FIGS. 1 and 2. The next building module 20 is then deposited above the lower module forming a second tier. These steps are repeated until the desired wall height is achieved.

Figure 3:
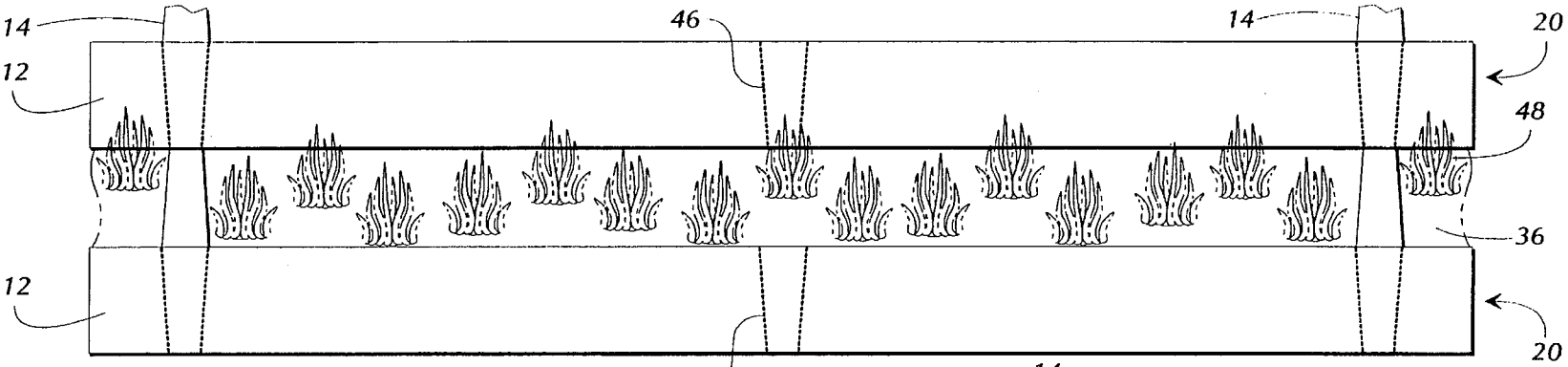
FIG. 3 is a partial front elevational view of two building modules stacked one on top of the other in the vertical direction with plants placed in the planting mix in the space created between the building modules.

Plants 48 are placed in the planting mix 36 in the vertical space formed between longitudinal bins 12 as shown in FIG. 3. The vertical space is created by the cross beam support blocks 14 and 18.

As shown in FIG. 4, the cross beam support blocks 14 extend vertically a short distance above the longitudinal bins 12 and have planar top and bottom sides. Each cross beam support block 14 has an alignment key 62 extending vertically from its top side and alignment pockets 63 recessed in its bottom side. The alignment key and alignment pockets can be used to offset the building modules 20 horizontally in a direction transverse to the wall plane as the building modules are stacked vertically one upon the other as shown in FIG. 2. The building modules 20 can therefore be used to construct either a freestanding wall or retaining wall without changing the design or structure of the building module.

As shown in the cross sectional view of FIG. 4A, the longitudinal bin 12 is a three sided structure. The bottom is a horizontal member and is substantially parallel to the horizontal wall plane. The side members extend upwardly from each side of the bottom member. The interior side and exterior side members extend upwardly and outwardly at an angle from the bottom member so as to form a wide-mouthed bin or trough. The interior side and the bottom of the longitudinal bin have a uniform thickness which is greater than or equal to the thickness of the exterior side. This is necessary for the structural stability of the longitudinal bin when it is under load.

The longitudinal bins 12 can also be formed with root development slots 64 through the interior sides of the bins. These slots allow plant roots to expand into the center portion of the module 68, thereby increasing plant growth and extending plant longevity. The dimensions and location of the slots may vary based upon the size and type of plant within the bin; however, the slot should be positioned above the retained water line 66 as determined by the height of the weir 32.

The longitudinal bins 12 are positioned parallel to one another in the direction of the wall plane, and are both separated and supported by the cross beam support block 14 and cross beam 46, connected thereto at substantially right angles. The cross beam 46, which is substantially in the center of the building module 20, connects only the interior side of the first longitudinal bin to the interior side of the second longitudinal bin. The cross beam support blocks 14 connect the exterior side of the first longitudinal bin to the exterior side of the second longitudinal bin. In so doing the cross beam support blocks 14 pass through and connect to the interior sides and bottoms of both longitudinal bins. The advantage of this type of construction lies in the fact that the entire cross-sectional area of the longitudinal bins 12 is secured to the cross beam support blocks 14 thereby forming a building module 20 which is less susceptible to damage due to the various moments and torque placed upon the longitudinal bins 12 by the bulk filling material and planting mix.

Under normal conditions, rainfall will provide an ample supply of water for the plants in the longitudinal bins. If additional water is needed, it is supplied by means of an irrigation system as shown in FIGS. 4 and 4A. Each cross beam support block 14 is configured with two sets of holes; two equalizing holes 30 disposed immediately above the bottom of the longitudinal bins 12, and irrigation pipe holes 26 located above the equalizing holes approximately at the level of the interior walls of the bins. Irrigation pipe 50 is mounted through the irrigation pipe holes 26 along one side of the building module 20, as shown in FIG. 4. A saddle 52 is attached to the pipe near each crossbeam 46. A reducer 54 connects the saddle to a smaller section of pipe 58 controlled by a gate valve 56 as shown in FIG. 4A. The pipe 58 enters the top of the crossbeam 46 and continues downward through the crossbeam where it changes direction approximately 90 ° in both directions at a T intersection. The pipe 58 exits the cross beam at irrigation openings 60 near the bottom of the longitudinal bins 12. In one embodiment, the pipe 58 ends at the irrigation openings and water flows out of these openings directly into the rock in the bottom of the bins. The interstices between the rocks allows water to flow throughout the length of the bins, thereby watering the roots of the plants. An alternate embodiment (not shown) involves connecting a riser pipe to the end of the pipe 58 at the irrigation openings 60, and running this riser vertically to the top of the planting mix in each bin. The riser is connected to a soaker hose, sprinkler head, spray hoses, or any number of above-ground spray systems for watering the tops of the plants. The flow and pressure of the water supplied to the irrigation openings 60, can be manually set and controlled from the gate valve 56 or can be automatically controlled by a timer, as is well known in the art.

FIG. 5 shows another embodiment of the building module 22. This module forms the tier immediately below the top tier. Longitudinal bins 16 differ from longitudinal bins 12 of building module 20 in FIG. 4 in that the height of the interior side of longitudinal bin 16 does not equal the height of the exterior side of longitudinal bin 16. Instead, the height of the interior side of longitudinal bin 16 equals the height of the weir 32. For this reason there is no need for root development slots in this building module 22. Additionally, gravel is not compacted in the bulk fill material space 68 of the building module. Instead, only a suitable planting mix 36 fills the bulk fill material space 68.

The building module 24, shown in FIG. 6, is the building module used as the top tier in both the freestanding wall and the retaining wall. This building module differs from building module 22 in FIG. 5 in that the cross beam support blocks 18 have been replaced with cross beams 17. The cross beams 17 connect the exterior side of the first longitudinal bin 16 to the exterior side of the second longitudinal bin 16, but the vertical height of the cross beam is only equal to the height of the weir.

It is to be understood that the invention is not limited in its application to the detail of construction and arrangement of parts illustrated in the drawings since the invention is capable of other embodiments and of being practiced or carried out in various ways. It should also be understood that the phraseology or terminology employed is for the purpose of description only and not of limitation.

I claim:

1. A wall structure forming a substantially upright, planar bin wall for receiving and supporting a bulk filling material and defining a generally vertical wall plane, said wall structure comprising a longitudinal bin extending substantially parallel to the wall plane, at least one cross beam extending substantially perpendicular to the wall plane and to said longitudinal bin, and at least one weir in said longitudinal bin for retaining water.

2. A wall structure as defined in claim 1, in which said wall structure includes a plurality of building modules, each of said modules having said bin on each side thereof, said bin being connected by said cross beam to create a rectilinear module.

3. The wall structure of claim 1, further comprising an irrigation system for supplying water to the longitudinal bin.

4. The wall structure of claim 1, wherein said longitudinal bin includes a first end and a second end, each of said ends having a weir therein.

5. The wall structure of claim 1 and including first and second cross beam support blocks each having an alignment key and a plurality of alignment pockets.

6. The wall structure of claim 5, wherein said first and second cross beam support blocks further comprise means defining a plurality of holes, including water level equalizing holes and irrigation pipe holes.

7. The wall structure of claim 1, in which said longitudinal bin includes root development slots along interior sides of said longitudinal bin through which roots of plants can extend into said bulk filling material.

8. The wall structure of claim 7, in which said wall structure includes a plurality of irrigation openings and an irrigation system in said longitudinal bin.

9. A building module for the construction of freestanding, sound absorbing reducing walls, and retaining walls, comprising a first and second longitudinal bin having an irrigation system and a plurality of irrigation openings extending substantially parallel to a wall plane, at least one cross beam extending substantially perpendicular to the wall plane, a first and second cross beam support block extending substantially perpendicular to the wall plane, and means for retaining water in each of said first and second longitudinal bins, said first and second longitudinal bins being joined with said cross beam and said first and second cross beam support blocks at an angle, and a bulk filling material disposed therebetween for forming one building module.

10. The building module of claim 9, wherein said first and second longitudinal bins comprise a planar bottom side parallel to the wall plane, a planar exterior side extending upwardly and outwardly at an angle from one end of the bottom with respect to the center of the wall, and a planar interior side extending inwardly and upwardly at an angle from the other end of the bottom with respect to the center of the wall.

11. The building module of claim 9, wherein said first and second longitudinal bins further comprise an interior side and a bottom side having equivalent cross sectional widths which are equal to, or greater than a cross sectional width of said exterior side.

12. The building module of claim 10, wherein said first and second longitudinal bins include root development slots along the interior sides of said first and second longitudinal bins.

13. The building module of claim 10, wherein said first and second cross beam support blocks comprise planar top and bottom surfaces extending perpendicular to the wall plane, at a height greater than the height of said exterior sides of said first and second longitudinal bins.

14. The building module of claim 9, wherein said first and second cross beam support blocks include an alignment key and a plurality of alignment pockets.

15. The building module of claim 9, wherein said cross beam support blocks further include means defining a plurality of holes, water level equalizing holes and irrigation pipe holes.

16. The building module of claim 10, wherein said cross beam has planar top and bottom sides extending perpendicular to the wall plane, and having a height equal to the height of the interior side of said first and second longitudinal bins.

17. The building module of claim 9, wherein said means for retaining water comprises a weir at each end of said first and second longitudinal bin.

18. The building module of claim 9, further comprising an irrigation system for supplying water to the longitudinal bins.

19. A root development system for supporting and maintaining plant growth within a wall structure, said system comprising a longitudinal bin having an elongated interior side and at least one elongated slot disposed therethrough, and at least one weir for retaining water within said bin, said slot being located at or above a retained water level line within said bin and allowing for the migration of plant roots out of said bin, into a bulk filling material and down to the soil at the base of the wall.

20. The root development system of claim 19, further comprising at least one first and second longitudinal bin extending substantially parallel to the wall plane, at least one cross beam extending substantially perpendicular to the wall plane and, at least one first and second cross beam support block extending substantially perpendicular to the wall plane.

21. The root development system of claim 19, further comprising an irrigation system for supplying water to each of said first and second longitudinal bins capable of maintaining a water level equal to the height of said weir.

22. A wall structure forming a substantially upright, planar bin wall for receiving and supporting a bulk filling material and defining a generally vertical wall plane, said wall structure comprising at least one longitudinal bin extending substantially parallel to the wall plane, at least one cross beam extending substantially perpendicular to the wall plane and to said longitudinal bin for retaining water in said longitudinal bin, first and second cross beam support blocks having an alignment key and a plurality of alignment pockets, and wherein said first and second cross beam support blocks further comprise a plurality of holes, including water level equalizing holes and irrigation pipe holes.

23. A wall structure forming a substantially upright, planar bin wall for receiving and supporting a bulk filling material and defining a generally vertical wall plane, said wall structure comprising at least one longitudinal bin extending substantially parallel to the wall plane, at least one water retainer in said longitudinal bin, at least one root development slot along an interior side of said longitudinal bin means, and an irrigation system having irrigation openings in said bin means.

24. A building module for the construction of free standing, sound absorbing/reducing walls, and retaining walls, comprising a first and second longitudinal bin extending substantially parallel to a wall plane, a cross beam extending substantially perpendicular to the wall plane, a first and second cross beam support block extending substantially perpendicular to the wall plane, said cross beam support blocks further including means defining a plurality of holes, water level equalizing holes and irrigation pipe holes, and means for retaining water in each of said first and second longitudinal bins, said first and second longitudinal bins being joined with said cross beam and said first and second cross beam support blocks at an angle, and a bulk filling material disposed therebetween for forming one building module.

25. A building module for the construction of free standing, sound absorbing/reducing walls, and retaining walls, comprising a first and second longitudinal bin extending substantially parallel to a wall plane, a cross beam extending substantially perpendicular to the wall plane, said cross beam having planar top and bottom sides extending perpendicular to the wall plane, and having a height equal to the height of an interior side of said first and second longitudinal bins, a first and second cross beam support block extending substantially perpendicular to the wall plane, and means for retaining water in each of said first and second longitudinal bins, said first and second longitudinal bins being joined with said cross beam and said first and second cross beam support blocks at an angle, and a bulk filling material disposed therebetween for forming one building module.

26. A building module for the construction of free standing, sound absorbing/reducing walls, and retaining walls, comprising a first and second longitudinal bin extending substantially parallel to a wall plane, a cross beam extending substantially perpendicular to a wall plane, a first and second cross beam support block extending substantially perpendicular to the wall plane, and means for retaining water in each of said first and second longitudinal bins including at least one weir, said first and second longitudinal bins being joined with said cross beam and said first and second cross beam support blocks at an angle, and a bulk filling material disposed therebetween for forming one building module.

27. A root development system for supporting and maintaining plant growth within a wall structure, said system comprising a longitudinal bin having an elongated interior side and at least one elongated slot disposed therethrough, weir means for retaining water within said bin, and an irrigation system for supplying water to said bin, said slot being located at or above a retained water level line and allowing for the migration of plant roots out of said bin.

28. A wall structure forming a substantially upright, planar bin wall for receiving and supporting a bulk filling material and defining a generally vertical wall plane, said wall structure comprising bin means extending substantially parallel to the wall plane and means for retaining water in said bin means including at least one weir.

29. A wall structure forming a substantially upright, planar bin wall for receiving and supporting a bulk filling material and defining a generally vertical wall plane, said wall structure comprising longitudinal bin means extending substantially parallel to the wall plane, at least one cross beam extending substantially perpendicular to the wall plane and to said bin means, and means for retaining water, including at least one weir in said longitudinal bin means.

* * * * *